US010508889B1

(12) United States Patent
Lynn et al.

(10) Patent No.: US 10,508,889 B1
(45) Date of Patent: Dec. 17, 2019

(54) METHOD AND APPARATUS FOR LASER-INDUCED PLASMA FILAMENTS FOR AGILE COUNTER-DIRECTED ENERGY WEAPON APPLICATIONS

(71) Applicant: The United States of America as represented by the Secretary of the Navy, San Diego, CA (US)

(72) Inventors: Brittany E. Lynn, San Diego, CA (US); Alexandru Hening, San Diego, CA (US); Ryan P. Lu, San Diego, CA (US)

(73) Assignee: United States of America as Represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 16/009,680

(22) Filed: Jun. 15, 2018

(51) Int. Cl.
*F41H 13/00* (2006.01)

(52) U.S. Cl.
CPC ..... *F41H 13/0031* (2013.01); *F41H 13/0062* (2013.01)

(58) Field of Classification Search
CPC ..... F41H 13/0031; F41H 13/0062
USPC ..... 250/396 R, 397, 493.1, 504 R
See application file for complete search history.

(56) References Cited

U.S. PATENT DOCUMENTS 9,088,123 B2 * 7/2015 Jones ..... H01S 1/04
2014/0231679 A1 * 8/2014 Kremeyer ..... G02F 1/3511 250/505.1
2016/0097616 A1 * 4/2016 Weigold ..... F41H 13/0062 250/396 R
2016/0254865 A1 * 9/2016 Hening ..... H04B 10/1123 398/104
2017/0045458 A1 * 2/2017 Hening ..... G01N 21/718

OTHER PUBLICATIONS

Turcu et al., "Spatial coherence measurements and x-ray holographic imaging using a laser-generated plasma x-ray source in the water window spectral region," J. Appl. Phys. 73(12), pp. 8081-8087; http://dx.doi.org/10.1063/1.353924. Jun. 1993.
Hening et. al., "Applications of laser induced filaments for optical communication links," SPIE Optical Engineering + Applications, Proc. of SPIE 9224, 92240J, pp. 1-8. Oct. 2014.

(Continued)

*Primary Examiner* — Nicole M Ippolito
(74) *Attorney, Agent, or Firm* — Naval Information Warfare Center, Pacific; Kyle Eppele; James McGee

(57) ABSTRACT

A method comprising the steps of propagating an infrared laser pulse in air, self-focusing the laser pulse until the laser reaches a critical power density, wherein molecules in the air ionize and simultaneously absorb a plurality of infrared photons resulting in a clamping effect on the intensity of the pulse, wherein the laser pulse defocuses and plasma is created, causing a dynamical competition between the self-focusing of the laser pulse and the defocusing effect due to the created plasma, the laser pulse maintaining a small beam diameter and high peak intensity over large distances, creating a plasma column, repeating the above steps to create a plurality of plasma columns, creating a parallel linear array with the plurality of plasma columns, and using the array to deflect an incident energy.

18 Claims, 3 Drawing Sheets

(56) References Cited

OTHER PUBLICATIONS

Ursu et. al., "Threshold conditions for the air plasma initiation near solid surfaces under the action of powerful pulsed C02 laser radiation," J. Appl. Phys. 58(5), pp. 1765-1771. Sep. 1985.
Couairon, "Filamentation length of powerful laser pulses," Appl. Phys. B 76, pp. 789-792. Jul. 2003.
Schillinger et. al., "Electrical conductivity of long plasma channels in air generated by self-guided femtosecond laser pulses," Appl. Phys. B 68, pp. 753-756. 1999.
Mathew, "Electronically steerable plasma mirror based radar—concept and characteristics," IEEE AES Sys. Mag., pp. 38-44. Oct. 1996.
Lynn, SSC Pacific FY17 Basic Research S&T Proposal USPL Induced Plasma Shield for Counter Directed Energy Weapon Applications. Jun. 2016.
Lynn et. al., "Interaction of Electromagnetic Energy with USPL Induced Plasma," Directed Energy Systems Symposium. Sep. 2016.

* cited by examiner

METHOD AND APPARATUS FOR LASER-INDUCED PLASMA FILAMENTS FOR AGILE COUNTER-DIRECTED ENERGY WEAPON APPLICATIONS

FEDERALLY-SPONSORED RESEARCH AND DEVELOPMENT

The Method and Apparatus for Laser-Induced Plasma Filaments for Agile Counter-Directed Energy Weapon Applications is assigned to the United States Government and is available for licensing for commercial purposes. Licensing and technical inquiries may be directed to the Office of Research and Technical Applications, Space and Naval Warfare Systems Center, Pacific, Code 72120, San Diego, Calif., 92152; voice (619) 553-5118; email ssc_pac_T2@navy.mil. Reference Navy Case Number 104178.

BACKGROUND

Directed energy weapons such as high energy laser and high power radio frequency threats are under rapid development. These types of weapons destroy sensors and electronics systems and in some cases can result in damage to the platform itself. In response, threat detection, mitigation and protection technologies need to be developed to protect military assets from their deployment. Current methods of mitigation include sending jets of water or clouds of smoke into the path to diffuse the energy and reduce the threat to the asset. These methods require a significant amount of time to deploy and do nothing to negate the ability of the weapon's future use. Described herein is a technique to deflect and/or reflect a high energy laser or radio frequency wave using a plasma-based free-space structure. The plasma is created via a laser source to enable a fast deployable defense system.

DETAILED DESCRIPTION OF SOME EMBODIMENTS

Reference in the specification to "one embodiment" or to "an embodiment" means that a particular element, feature, structure, or characteristic described in connection with the embodiments is included in at least one embodiment. The appearances of the phrases "in one embodiment", "in some embodiments", and "in other embodiments" in various places in the specification are not necessarily all referring to the same embodiment or the same set of embodiments.

Some embodiments may be described using the expression "coupled" and "connected" along with their derivatives. For example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or.

Additionally, use of the "a" or "an" are employed to describe elements and components of the embodiments herein. This is done merely for convenience and to give a general sense of the invention. This detailed description should be read to include one or at least one and the singular also includes the plural unless it is obviously meant otherwise.

The embodiment herein describes a system and method using laser-induced plasma filaments (LIPF). Laser-beam propagation through the atmosphere is influenced by many system parameters such as excitation energy, temporal and spatial beam profile, wavelength, repetition rate or continuous wave operation, etc. Laser-beam propagation is dependent on atmosphere composition and density that is affected by region, elevation, and temperature.

Figure 1:
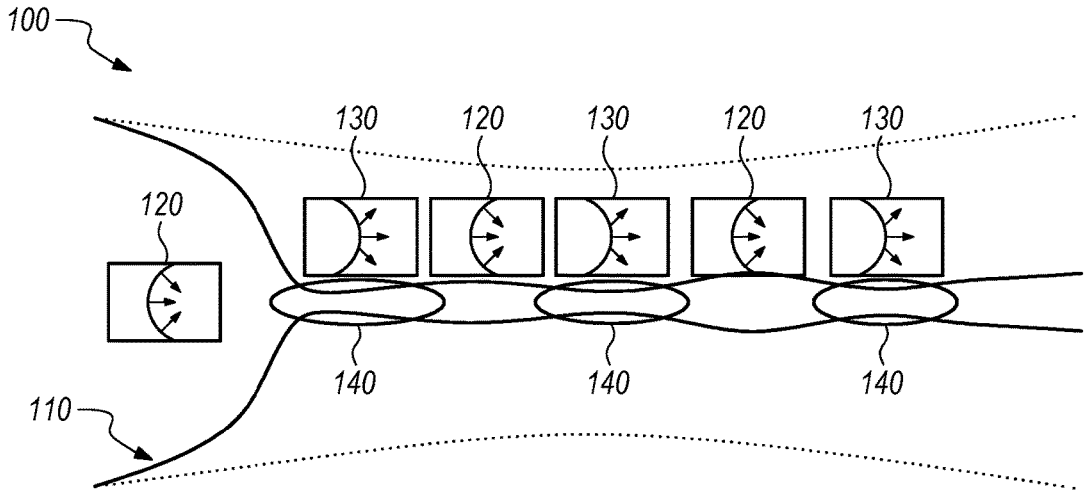
FIG. 1 shows a diagram demonstrating the competition between the optical Kerr effect and the diffraction from the plasma in accordance with the method and apparatus for laser-induced plasma filaments for agile counter-directed energy weapon applications.

FIG. 1 shows a diagram 100 of an intense laser pulse 110 with peak power exceeding the critical power threshold as it first undergoes self-focusing.

Critical power threshold for self-focusing:

$$P_{cr} = \frac{3.72\lambda_0^2}{8\pi n_0 n_2}$$

An intense laser pulse has the power required to start self-focusing as defined by the propagation media, on the order of Gigawatts of peak power for near-infrared propagation through sea-level air. Laser pulse 110 can be infrared or ultraviolet. The self-focusing of laser pulse 110 is due to an optical Kerr effect 120 and the diffraction from the resulting plasma 130.

$n=n_0+n_2I$ where $n_2$ is $\sim 10^{-23}$ $m^2/W$ Optical Kerr Effect:

During its propagation in air, the intense laser pulse 110 first undergoes self-focusing, because of the optical Kerr effect, until the peak intensity becomes high enough ($\sim 5*10^{13}$ W/cm$^2$) to ionize air molecules. The ionization process involves the simultaneous absorption of 8-10 infrared photons, and has a threshold-like behavior and a strong clamping effect on the intensity in the self-guided pulse, further described below. A dynamical competition then starts taking place between the self-focusing effect due to the optical Kerr effect and the defocusing effect due to the created plasma 130. During the dynamical competition, there is an equilibrium in the propagation between the self-focusing effect and the plasma defocusing effect. Plasma Defocus: $n_p=\sqrt{1-N/N_c}$ where N is the number of free electrons and $N_c$ is the critical plasma density.

When the self-focusing gets high, it creates resulting plasma 130 which causes defocusing. When the intensity is lower due to plasma 130 defocusing, then it starts to self-focus again. This repeating of focusing and defocusing, called self-guiding, continues until the peak intensity is no longer high enough to return to self-focusing and the laser beam begins propagating in a normal fashion.

Peak Pulse Intensity Due to Intensity Clamping $$I \sim \left(\frac{0.76 n_2 \rho_c}{\sigma_K t_p \rho_{nt}}\right)^{1/(K-1)}$$

Peak Plasma Density $$\rho(I) \sim \left(\frac{(0.76 n_2 \rho_c)^K}{\sigma_K t_p \rho_{nt}}\right)^{1/(K-1)}$$

Filament Size $$\omega_0 \sim \left(\frac{2P_{cr}}{\pi}\right)^{\frac{1}{2}} \times \left(\frac{\sigma_K t_p \rho_{nt}}{0.76 n_2 \rho_c}\right)^{1/2(K-1)}$$

As a result, the pulse maintains a small beam diameter and high peak intensity over large distances. In the wake of the self-guided pulse, a plasma column 140 is created with an initial density of $10^{13}$-$10^{17}$ electrons/cm3 over a distance which depends on initial laser conditions. This length can reach hundreds of meters at higher powers and typical LIPF equivalent resistivity could be as low as 0.1 Ω/cm. These types of parameters support plasma/electromagnetic field interactions such as reflection and refraction. Optical beams of low power propagate in a manner that is described by standard Gaussian propagation equations. In this type of propagation, the beam size at the focus of the system is only generally maintained to a distance around the focal region called the Rayleigh range. In high-power self-guiding propagation, this small beam size is maintained as long as the pulse intensity is high enough to continue generating Kerr self-focusing, generally 10*x* or more the Rayleigh range.

Through optical beam forming techniques, an array of plasma columns 140 can be created, forming a sheet-like plasma, creating a layer of excited electrons in the air. This layer can be used as a reflective surface, or mirror, for incident energies whose frequencies are below the plasma frequency, reflecting the power away from the intended path. The layer can also be used instead to deflect, diffract, or redirect the incident energy in a different direction.

Figure 2:
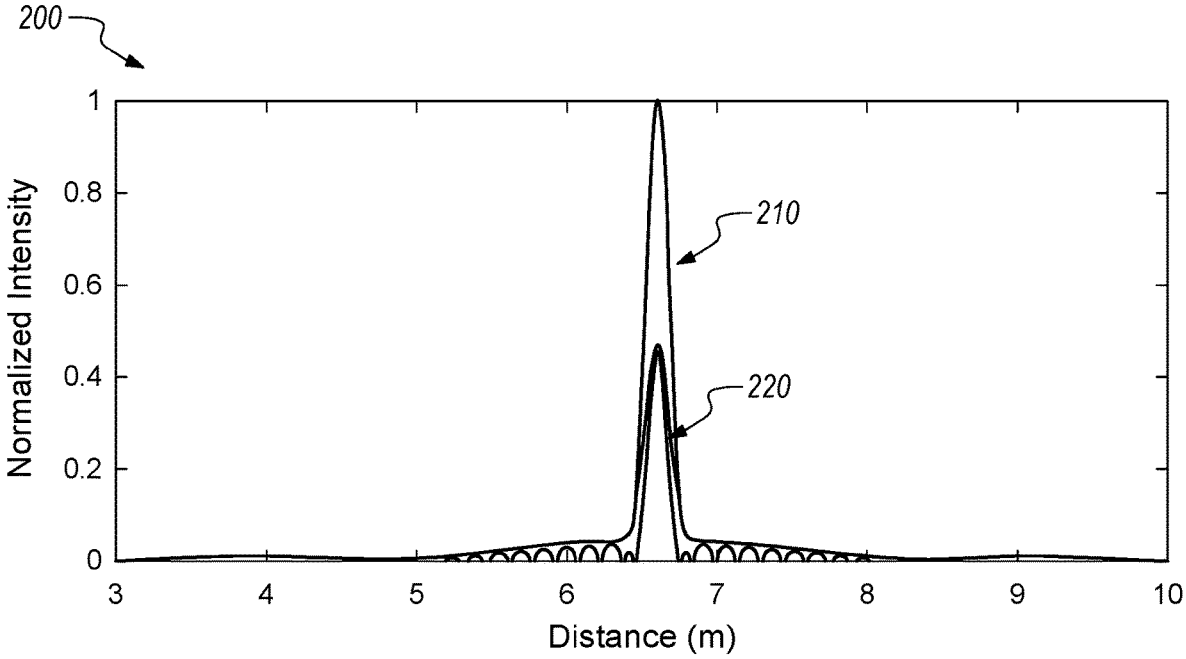
FIG. 2 shows a graph demonstrating peak power of an incident beam diffracted (or redirected) into the surrounding area in accordance with the method and apparatus for laser-induced plasma filaments for agile counter-directed energy weapon applications.

FIG. 2 shows a graph 200 demonstrating the difference between the original, un-diffracted incident beam 210 focused onto the target versus a diffracted incident beam 220 that has gone through the plasma array. Graph 200 demonstrates peak power of diffracted (or redirected) incident beam 220 into the surrounding area, reducing the total energy incident on any one area. In graph 200, the parameters for the analysis were 4 cm filament spacing, 100 μm diameter filaments, an incident linearly propagating, collimated beam with a wavelength of 1 μm, a 0.1 m beam waist radius. Graph 200 shows the result of diffracted incident beam 220 after propagation 5 meters past the filament array. This same result is obtained with for a 10 μm wavelength beam propagated 0.5 meters past the filament array. The analysis space was 12 meters in radial extent.

Figure 3:
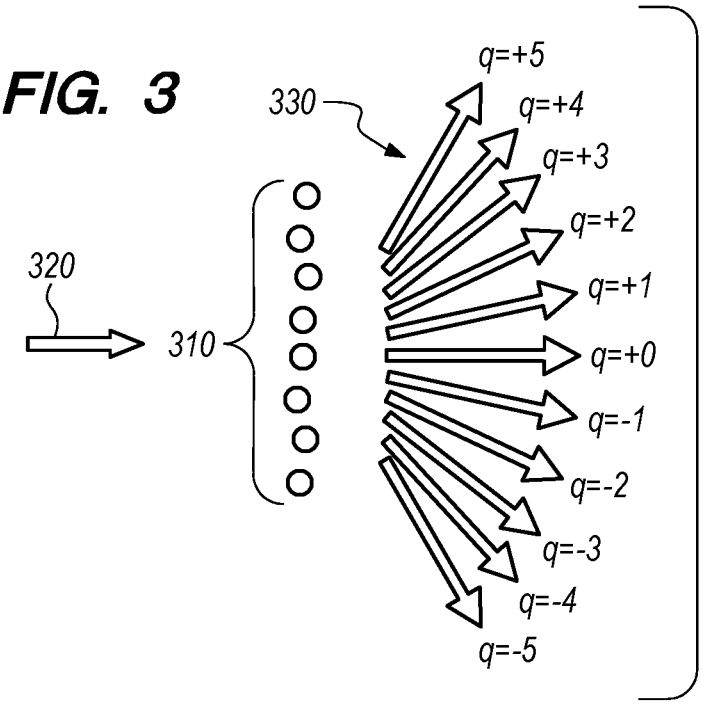
FIG. 3 shows an example of transmission grating in accordance with the method and apparatus for laser-induced plasma filaments for agile counter-directed energy weapon applications.

An embodiment of this system could be implemented in such a way to create either a reflection grating or a transmission grating. An example of a transmission grating is shown in FIG. 3. In FIG. 3, a plurality of plasma filaments 310 are arranged in a parallel linear array to form a plane of filaments spaced by a distance on the order of the wavelength of the incident energy. Incident beam 320, disclosed as laser energy but could be RF or another wavelength, is diffracted into multiple angles 330 and the energy is distributed across the space, reducing the ability for incident beam 320 to damage its target. Incident beam 320 can be used as "weapon" energy, either a laser beam or other high energy wave such as radio frequency, etc.

Figure 4:
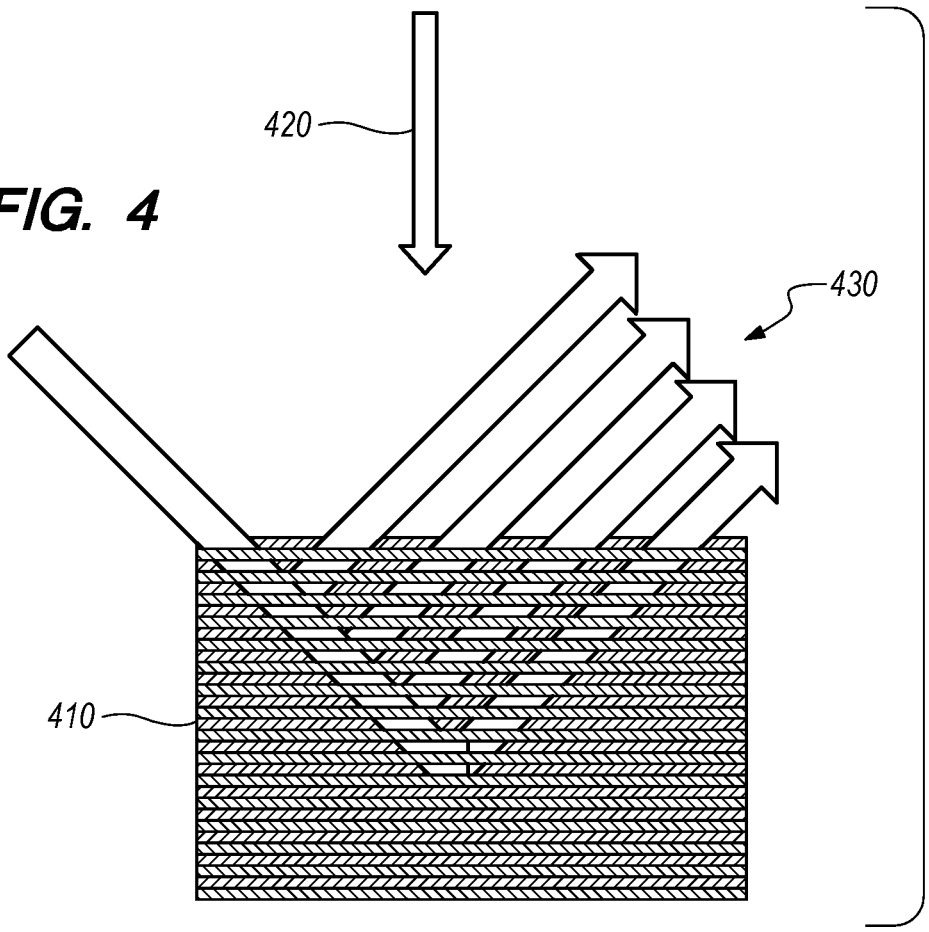
FIG. 4 shows an example of reflective grating in accordance with the method and apparatus for laser-induced plasma filaments for agile counter-directed energy weapon applications.

FIG. 4 shows an example of a reflection grating. In FIG. 4, plasma shield 410 is created via a combination of plasma filaments. Where incident energy 420 exists, plasma shield 410 can be used to reflect back some of that incident energy 420, as shown with reflective energy 430, instead of allowing it to continue through the plasma shield 410 when incident energy 420 is being used as a threat. Incident energy 420, once it is reflected back, can potentially be reflected back in the direction of the source and potentially blinding a pointing and tracking device on the threat side. In this case, the reflection would not be perfect, but rather would be a combination of reflection and transmission due to the discrete nature of filaments. A number of the filaments would be arranged in a layer (extending into the plane of the screen), and then a number of these layers would be stacked up as illustrated.

Figure 5:
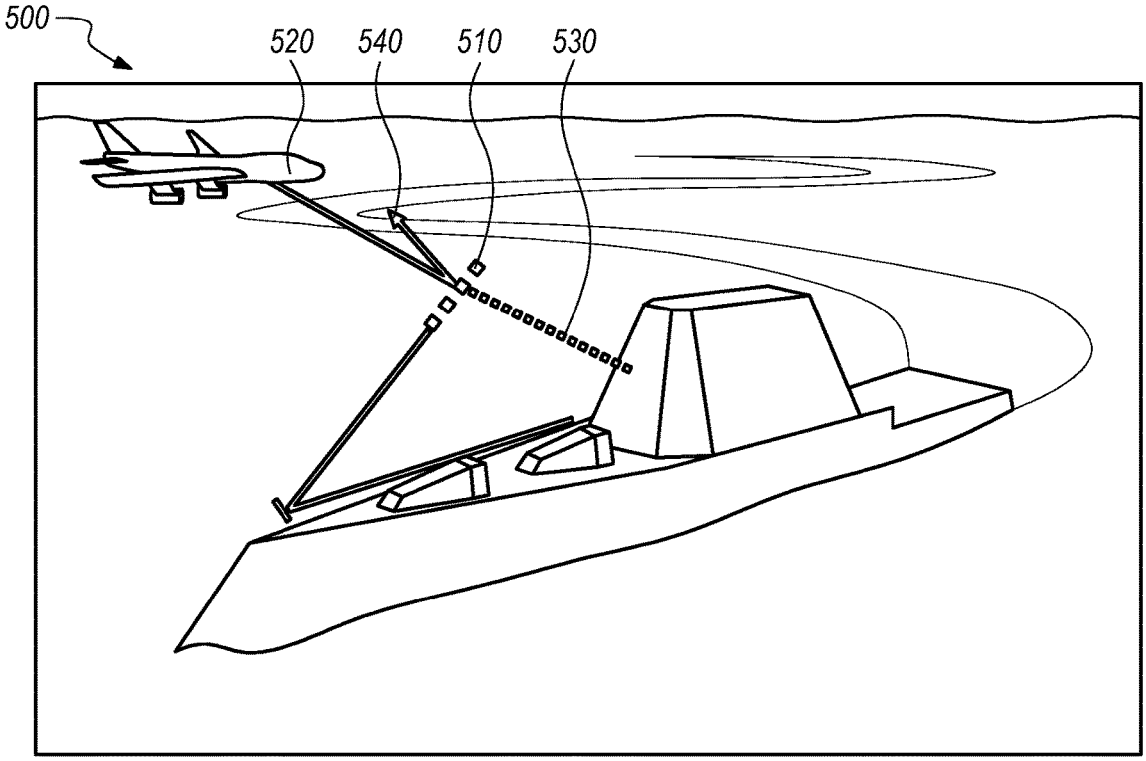
FIG. 5 shows an illustration of the reflective mode of a plasma mirror in accordance with the method and apparatus for laser-induced plasma filaments for agile counter-directed energy weapon applications.

FIG. 5 shows an illustration 500 of the reflective mode of a plasma mirror. A potential path 510 for a laser beam 520 indicates the location of a plasma plane. Laser beam 520 can be an incoming, high-powered source of energy with an intended path 530. However, laser beam 520 can turn into reflected/redirected energy 540 due to the plasma plane located at path 510.

For incident energy whose frequency is above the plasma frequency, laser beam 520 will see a region of altered refractive index, causing the laser beam 520 to refract and defocus (also shown in FIG. 3). This reduces the energy density of the incoming beam 520 to a level that is no longer dangerous. The embodiment herein describes a fast, agile and covert method to instantaneously deploy a shield against high power lasers or microwaves with the ability to respond to a wide range of incident electromagnetic frequencies. Additionally, the configuration of the ionization could be optimized with appropriate feedback such that reflection of the energy is directed back toward the emitter. This has the potential not only to damage/destroy the source and pointing device, but can be used to track the origin of the weapon as well. When not in use, the device is turned off, producing no additional radar cross-section for detection.

Figure 6A:
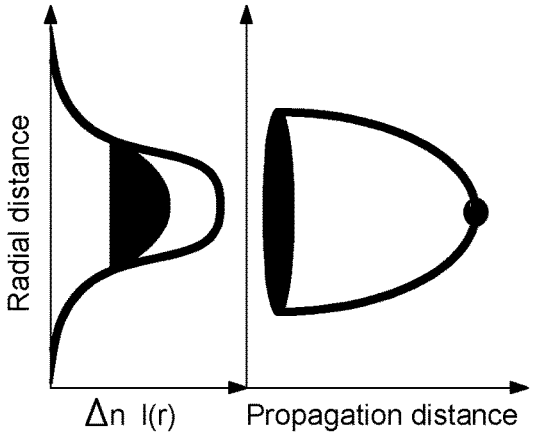
FIG. 6A shows a graph demonstrating the optical Kerr effect of the laser-induced plasma filaments in accordance with the method and apparatus for laser-induced plasma filaments for agile counter-directed energy weapon applications.
Figure 6B:
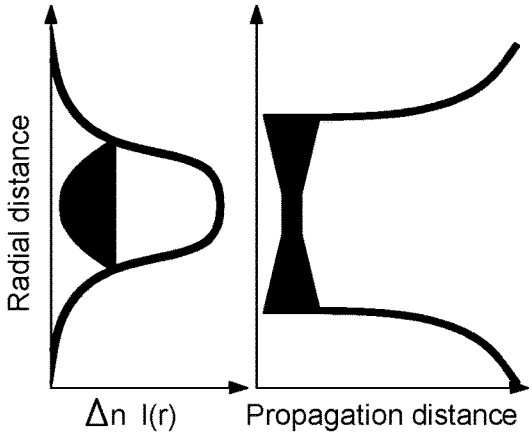
FIG. 6B shows a graph demonstrating the defocusing of the laser-induced plasma filaments in accordance with the method and apparatus for laser-induced plasma filaments for agile counter-directed energy weapon applications.

FIG. 6A shows a graph demonstrating the optical Kerr effect of the laser-induced plasma filaments. FIG. 6B shows a graph demonstrating the defocusing of the laser-induced plasma filaments.

The response time of the system described herein is on the order of millionths of seconds. The laser beam propagates with the speed of light and the ionization process requires only a few nanoseconds. Secondly, the proposed system covers a wide spectrum of incident frequencies; additionally, by changing the laser parameters (energy per pulse, repetition rate, wavelength), it is possible to fine tune the plasma shield to target a specific weapon capability. This system confers a high degree of flexibility and adaptability with the ability to be easily re-configured to counter future developments. This system is safe to store and transport; there are no flammable and/or toxic substances. Additionally, there are no expendable materials to transport or stock.

The ionized layer in the air could be formed using some other frequency of electromagnetic emission and/or different pulse durations. A use case tailored specifically to high-powered RF could employ a comb of ionized filaments to reflect/refract the incoming energy instead of having to create an entire plane. A series of successive planes could be set up in air (conceptually a stack of planes separated by some distance) such that the interaction of each one adds to the cumulative effect of the "shield". A secondary electromagnetic radiation beam could be employed to extend the lifetime of the ionized regions in the air.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. A method comprising the steps of:

propagating an infrared laser pulse in air;

self-focusing the laser pulse until the laser reaches a critical power density, wherein molecules in the air ionize and simultaneously absorb a plurality of infrared photons resulting in a clamping effect on the intensity of the pulse, wherein the laser pulse defocuses and plasma filaments are created;

causing a dynamical competition between the self-focusing of the laser pulse and the defocusing effect due to the created plasma;

the laser pulse maintaining a small beam diameter and high peak intensity over large distances;

creating a plasma column;

repeating the above steps to create a plurality of plasma columns;

creating a parallel linear array with the plurality of plasma columns;

using the array to deflect an incident energy.

2. The method of claim 1, wherein the plurality of plasma columns is arranged in a parallel linear array spaced by a distance on the order of the wavelength of the incident energy.

3. The method of claim 2, wherein the incident energy is laser energy.

4. The method of claim 2, wherein the incident energy is radio frequency.

5. The method of claim 1, wherein the incident energy is diffracted into multiple angles, the incident energy being distributed across space.

6. The method of claim 1, wherein the plurality of plasma columns forms a sheet-like plasma creating a layer of excited electrons.

7. The method of claim 6, wherein the sheet-like plasma is used as a reflective surface for incident energies, resulting in reflected incident energy.

8. The method of claim 7, wherein the incident energy is being used as a weapon to reach a specific target.

9. The method of claim 8, wherein the reflected incident energy is returned to a source from which the incident energy originated.

10. The method of claim 9, wherein the source is damaged.

11. The method of claim 10, wherein the origin of the source is determined.

12. A method to counter-direct energy weapons comprising the steps of:

using a laser source and optical beam forming techniques to create a plurality of plasma columns having a specific frequency, wherein the plurality of plasma columns forms a sheet-like plasma;

creating a layer of excited electrons in the air;

using the layer of excited electrons as a reflective surface, using the reflective surface to reflect incident energy, wherein the incident energy originates from a specific source and is being used as a weapon.

13. The method of claim 12, wherein the incident energy has a frequency below the frequency of the plasma columns.

14. The method of claim 13, wherein the incident energy is reflected back to the specific source.

15. The method of claim 14, wherein the reflected incident energy allows for tracking of the specific source.

16. A method to counter-direct energy weapons comprising the steps of:

using a laser source and optical beam forming techniques to create a plurality of plasma filaments having a specific frequency, wherein the plurality of plasma filaments forms a parallel linear array;

using the parallel linear array to create a plane of filaments;

directing an incident energy, wherein the incident energy has a specific wavelength, from an original source to the plane of filaments, wherein the incident energy is being used as a weapon;

spacing the plane of filaments by a distance on the order of the wavelength of the incident energy;

diffracting incident energy into multiple angles upon the incident energy reaching the plane of filaments;

distributing the incident energy across space.

17. The method of claim 16 wherein the incident energy is a laser beam.

18. The method of claim 16, wherein the incident energy is a high energy wave.

* * * * *